United States Patent [19]

Ghandehari

[11] Patent Number: 4,878,958

[45] **Date of Patent: * Nov. 7, 1989**

[54] METHOD FOR PREPARING RARE EARTH-IRON-BORON PERMANENT MAGNETS

[75] Inventor: Mohammad H. Ghandehari, Brea, Calif.

[73] Assignee: Union Oil Company of California, Los Angeles, Calif.

[ * ] Notice: The portion of the term of this patent subsequent to Aug. 9, 2005 has been disclaimed.

[21] Appl. No.: 177,056

[22] Filed: Apr. 4, 1988

Related U.S. Application Data

[62] Division of Ser. No. 869,045, May 30, 1986, Pat. No. 4,747,874.

[51] Int. Cl.[4] ..... H01F 1/09

[52] U.S. Cl. ..... 148/103; 148/105

[58] Field of Search ..... 148/102, 103, 104, 105

[56] References Cited

U.S. PATENT DOCUMENTS

| | | | |
|---|---|---|---|
| 4,601,875 | 7/1986 | Yamamoto et al. | 148/104 |
| 4,762,574 | 8/1988 | Ghandehari | 148/104 |
| 4,770,723 | 9/1988 | Sagawa et al. | 148/302 |

FOREIGN PATENT DOCUMENTS

| | | | |
|---|---|---|---|
| 101552 | 2/1984 | European Pat. Off. . | |
| 83105473.5 | 2/1984 | European Pat. Off. . | |
| 83107351.5 | 5/1984 | European Pat. Off. . | |
| 126802 | 12/1984 | European Pat. Off. | 148/102 |
| 134304 | 3/1985 | European Pat. Off. . | |
| 134305 | 3/1985 | European Pat. Off. . | |
| 197843 | 10/1985 | Japan . | |

OTHER PUBLICATIONS

A. L. Robinson, "Powerful New Magnet Material Found," *Science*, vol. 223, pp. 920–922 (1984).

M. Sagawa, S. Fujimura, N. Togawa, H. Yamamoto, and Y. Matsuura "New Material for Permanent Magnets on a Base of Nd and Fe," *Journal of Applied Physics*, vol. 55, pp. 2083–2087 (1984).

M. Sagawa, S. Fujimura, H. Yamamoto, Y. Matsuura, and K. Hiraga, "Permanent Magnet Materials Based on the Rare Earth–Iron–Boron Tetragonal Compounds," *IEEE Transactions on Magnetics*, vol. MAG–20, Sep. 1984, pp. 1584–1589.

C. Herget, "Metallurgical Ways to NdFeB Alloys. Permanent Magnets from Co–Reduced NdFeB," presented at the 8th International Workshop on Rare–Earth Magnets and their Applications, Dayton, Ohio, May 6–8, 1985.

*Primary Examiner*—Richard O. Dean

*Assistant Examiner*—George Wyszomierski

*Attorney, Agent, or Firm*—Alan H. Thompson; Gregory F. Wirzbicki

[57] ABSTRACT

Permanent magnets are prepared by a method comprising mixing a particulate rare earth-iron-boron alloy with particulate aluminum, aligning the magnetic domains of the mixture, compacting the align mixture to form a shape, and sintering the compacted shape.

23 Claims, No Drawings

METHOD FOR PREPARING RARE EARTH-IRON-BORON PERMANENT MAGNETS

This application is a division of application Ser. No. 869,045, filed May 30, 1986, now U.S. Pat. No. 4,747,874.

INTRODUCTION TO THE INVENTION

The invention pertains to powder metallurgical compositions and methods for preparing rare earth-iron-boron permanent magnets, and to magnets prepared by such methods.

Permanent magnets (those materials which exhibit permanent ferromagnetism) have, over the years, become very common, useful industrial materials. Applications for these magnets are numerous, ranging from audio loudspeakers to electric motors, generators, meters, and scientific apparatus of many types. Research in the field has typically been directed toward developing permanent magnet materials having ever-increasing strengths, particularly in recent times, when miniaturization has become desirable for computer equipment and many other devices.

The more recently developed, commercially successful permanent magnets are produced by powder metallurgy sintering techniques, from alloys of rare earth metals and ferromagnetic metals. The most popular alloy is one containing samarium and cobalt, and having an empirical formula $SmCo_5$. Such magnets also normally contain small amounts of other samarium-cobalt alloys, to assist in fabrication (particularly sintering) of the desired shapes.

Samarium-cobalt magnets, however, are quite expensive, due to the relative scarcity of both alloying elements. This factor has limited the usefulness of the magnets in large volume applications such as electric motors, and has encouraged research to develop permanent magnet materials which utilize the more abundant rare earth metals, which generally have lower atomic numbers and less expensive ferromagnetic metals. The research has led to very promising compositions which contain neodymium, iron, and boron in various proportions. Progress, and some predictions for future utilities, are given for compositions described as $R_2Fe_{14}B$ (where R is a light rare earth) by A. L. Robinson, "Powerful New Magnet Material Found," *Science*, Vol. 223, pages 920–922 (1984).

Certain of the compositions have been described by M. Sagawa, S. Fujimura, N. Togawa, H. Yamamoto, and Y. Matsuura "New Material for Permanent Magnets on a Base of Nd and Fe," *Journal of Applied Physics*, Vol. 55, pages 2083–2087 (1984). In this paper, crystallographic and magnetic properties are reported for various $Nd_xB_yFe_{100-x-y}$ compositions, and a procedure for preparing permanent magnets from powdered $Nd_{15}B_8Fe_{77}$ is described. The paper discusses the impairment of magnetic properties which is observed at elevated temperatures and suggests that additions of small amounts of cobalt to the alloys can be beneficial in avoiding this impairment.

Additional information about the compositions is provided by M. Sagawa, S. Fujimura, H. Yamamoto, Y. Matsuura, and K. Hiraga, "Permanent Magnet Materials Based on the Rare Earth-Iron-Boron Tetragonal Compounds," *IEEE Transactions on Magnetics*, Vol. MAG-20, September 1984, pages 1584–1589. Small additions of terbium or dysprosium are said to increase the coercivity of neodymium-iron-boron magnets; a comparison is made between $Nd_{15}Fe_{77}B_8$ and $Nd_{13.5}Dy_{1.5}Fe_{77}B_8$ magnets.

Further instruction concerning the fabrication of rare earth-iron-boron magnets is given by M. Sagawa, S. Fujimura, and Y. Matsuura in European Patent Application 83106573.5 and 83107351.5 (filed, respectively, on July 5, 1983 and July 26, 1983), wherein the coercivity-enhancing effect of adding various metallic elements to the magnet alloys is discussed.

C. Herget, in a paper entitled "Metallurgical Ways to NdFeB Alloys. Permanent Magnets From Co-Reduced NdFeB," presented at the 8th International Workshop on Rare-Earth Magnets and their Applications, Dayton, Ohio, May 6–8, 1985, also discusses the addition of other metals to neodymium-iron-boron alloys.

SUMMARY OF THE INVENTION

One aspect of the invention is a method for producing rare earth-iron-boron permanent magnets, comprising the steps of: (1) mixing a particulate alloy containing at least one rare earth metal, iron, and boron, with particulate aluminum metal; (2) aligning magnetic domains of the mixture in a magnetic field; (3) compacting the aligned mixture to form a shape; and (4) sintering the compacted shape. Optionally, a particulate rare earth oxide or rare earth metal can be added in conjunction with the aluminum metal. The alloy can be a mixture of rare earth-iron-boron alloys and, in addition, a portion of the iron can be replaced by another ferromagnetic metal, such as cobalt. This invention also encompasses compositions for use in the method, and products produced thereby.

DETAILED DESCRIPTION OF THE INVENTION

As used herein, the term "rare earth" includes the lanthanide elements having atomic numbers from 57 through 71, plus the element yttrium, atomic number 39, which is commonly found in certain lanthanide-containing ores and is chemically similar to the lanthanides.

The term "heavy lanthanide" is used herein to refer to those lanthanide elements having atomic numbers 63 through 71, excluding the "light rare earths" with atomic numbers 62 and below.

"Ferromagnetic metals" include iron, nickel, cobalt, and various alloys containing one or more of these metals. Ferromagnetic metals and permanent magnets exhibit the characteristic of magnetic hysteresis, wherein plots of induction versus applied magnetic field strengths (from zero to a high positive value, and then to a high negative value and returning to zero) are hysteresis loops.

Points on the hysteresis loop which are of particular interest for the present invention lie within the second quadrant, or "demagnetization curve," since most devices which utilize permanent magnets operate under the influence of a demagnetizing field. On a loop which is symmetrical about the origin, the value of field strength (H) for which induction (B) equals zero is called coercive force ($H_c$). This is a measure of the quality of the magnetic material. The value of induction where applied field strength equals zero is called residual induction ($B_r$). Values of H will be expressed in Oersteds (Oe), while values of B will be in Gauss (G). A figure of merit for a particular magnet shape is the energy product, obtained by multiplying values of B and H for a given point on the demagnetization curve and expressed in Gauss-Oersteds (GOe). When these unit abbreviations are used, the prefix "K" indicates multiplication by $10^3$, while "M" indicates multiplication by $10^6$. When the energy products are plotted against B, one point ($BH_{max}$) is found at the maximum point of the curve; this point is also useful as a crtiteron for comparing magnets. Intrinsic coercivity ($iH_c$) is found where (B−H) equals zero in a plot of (B−H) versus H.

The present invention is a method for preparing permanent magnets based upon rare earth-iron-boron alloys, which invention also includes certain compositions useful in the method and the magnets prepared thereby. This method comprises mixing a particulate rare earth-iron-boron alloy with particulate aluminum metal, before the magnetic domain alignment, shape-forming, and sintering steps are undertaken.

Copending U.S. patent application Ser. No. 745,293, filed June 14, 1985 by the present inventor and incorporated herein by reference, describes an improvement in coercivity which is obtained in rare earth-iron-boron permanent magnets, by a method which involves the addition of a particulate rare earth oxide to alloy powders, before forming magnets. The method is exemplified by neodymium-iron-boron magnet compositions and is found to be particularly effective when compounds such as $Gd_2O_3$, $Tb_4O_7$, $Dy_2O_3$ and $Ho_2O_3$ are used as additives.

Suitable rare earth-iron-boron alloys for use in this invention include those discussed in the previously noted paper by Robinson, those by Sagawa et al., as well as others in the art. Magnets currently being developed for commercialization generally are based upon neodymium-iron-boron alloys, but the present invention is also applicable to alloy compositions wherein one or more other rare earths, particularly those considered to be light rare earths, replaces all or some fraction of the neodymium. In addition, a portion of the iron can be replaced by one or more other ferromagnetic metals, such as cobalt.

The alloys can be prepared by several methods, with the most simple and direct method comprising melting together the component elements, e.g., neodymium, iron, and boron, in the correct proportions. Prepared alloys are usually subjected to sequential particle size reduction operations, preferably sufficient to produce particles of less than about 200 mesh (0.075 millimeter diameter).

To the magnet alloy powder is added particulate aluminum metal, preferably having particle sizes and distributions similar to those of the alloy. Aluminum can be mixed with the alloy after the alloy has undergone particle size reduction, or can be added during size reduction, e.g., while the alloy is present in a ball mill. The alloy and aluminum are thoroughly mixed and this mixture is used to prepare magnets by the alignment, compaction, and sintering steps.

Enhanced coercivities are observed in finished magnets which have added aluminum in amounts about 0.05 to about 1 percent by weight of the magnet. In addition, a further increase in coercivity can be obtained by adding a rare earth oxide or metal, such as by the techniques described in copending Ser. No. 745,293, noted supra. A particular advantage from the addition of aluminum, according to the present invention, is an ability to obtain large increases in coercivity with smaller quantities of rare earth oxide or metal than would otherwise be used. Since aluminum is considerably less expensive than rare earth oxides or metals, the invention provides a significant economic benefit.

The optional rare earth oxide additive can be a single oxide or a mixture of oxides. Particularly preferred are oxides of the heavy lanthanides, especially dysprosium oxide and terbium oxides (appearing to function similarly to dysprosium and terbium metal additions, which were reported by Sagawa et al. in the *IEEE Transactions on Magnetics*, discussed supra). Suitable amounts of rare earth oxide are about 0.5 to about 10 weight percent of the magnet alloy powder; more preferably about 1 to about 5 weight percent is used.

The present invention offers advantages over the direct addition of aluminum metal into the magnet alloy, since a thorough blending of powders is significantly easier than blending molten metals.

The benefits resulting from the addition of rare earth oxide, as discussed above, can be obtained by adding powdered rare earth metal to the particles of magnet alloy and aluminum. Again, the heavy lanthanides are preferred, with dysprosium and terbium being especially preferred. Particle sizes and distributions are preferably similar to those of the magnet alloy, and a simple mixing of the alloy powder, aluminum, and additive metal powder precedes the alignment, compaction, and sintering steps for magnet fabrication.

The powder mixture is placed in a magnetic field to align the crystal axes and magnetic domains, preferably simultaneously with a compacting step, in which a shape is formed from the powder. This shape is then sintered to form a magnet having good mechanical integrity, under conditions of vacuum or an inert atmosphere (such as argon). Typically, sintering temperatures about 1060° C. to about 1100° C. are used.

By use of the invention, permanent magnets are obtained which have increased coercivity, over magnets prepared without added aluminum and rare earth oxide or rare earth metal powders. This is normally accompanied by a decrease in magnet residual induction, but nonetheless makes the magnet more useful for many applications, including electric motors.

The invention will be further described by the following examples, which are not intended to be limiting, the invention being defined solely by the apepnded claims. In these example, all percentage compositions are expressed on a weight basis.

EXAMPLE 1

An alloy having the nominal composition 33.5% Nd-65.2% Fe-1.3% B (approximately $Nd_{15}Fe_{77}B_8$) is prepared by melting together elemental neodymium, iron, and boron in an induction furnace, under an argon atmosphere. After the alloy is allowed to solidfy, it is heated at about 1070° C. for about 96 hours, to permit remaining free iron to diffuse into other alloy phases which are present. The alloy is cooled, crushed by hand tools to particle sizes less than about 70 mesh (0.2 millimeters diameter), and ball-milled under an argon atmosphere, in an organic liquid, to obtain a majority of particle diameters about 5 to 10 micrometers in diameter. After drying under a vacuum, the powdered alloy is ready for use to prepare magnets.

Samples of the alloy powder are used to prepare magnets, using the following procedure:

(1) aluminum powder is weighed and added to a weighed amount of alloy powder;

(2) the mixture is vigorously shaken in a glass vial by hand for a few minutes, to intimately mix the components;

(3) magnetic domains and crystal axes are aligned by a perpendicular field of about 14 KOe while the powder mixture is being compacted loosely in a die, then the pressure on the die is increased to about 10,000 p.s.i.g. for 20 seconds;

(4) the compacted "green" magnets are sintered under argon at about 1070° C. for one hour and then rapidly moved into a cool portion of the furnace and allowed to cool to room temperature.

(5) cooled magnets are annealed at about 900° C. under argon for about 2 hours and then rapidly cooled in the furnace, then are heated to about 630° C. for about 1 hour and again rapidly cooled as described above.

Properties of the prepared magnets are summarized in Table I. These data indicate that an aluminum additive significantly improves coercivity of a neodymium-iron-boron magnet.

TABLE I

| Aluminum Wt. Percent | $B_r$ (Gauss $\times 10^3$) | $H_c$ (Oersted $\times 10^3$) | $iH_c$ (Oersted $\times 10^3$) | $BH_{max}$ (MGOe) |
|---|---|---|---|---|
| 0 | 12.0 | 9.1 | 11.0 | 36.0 |
| 0.5 | 11.5 | 10.1 | 12.2 | 32.0 |

EXAMPLE 2

Magnets are prepared using the procedure of Example 1, except that different amounts of aluminum are added.

Table II summarizes the properties of these magnets. The data show the effects of various aluminum additive concentrations on magnetic properties, including a marked decrease in coercivity when aluminum is added in excess of about 1 percent by weight.

TABLE II

| Aluminum Wt. Percent | $B_r$ (Gauss $\times 10^3$) | $H_c$ (Oersted $\times 10^3$) | $iH_c$ (Oersted $\times 10^3$) | $BH_{max}$ (MGOe) |
|---|---|---|---|---|
| 0 | 12.0 | 9.0 | 11.0 | 36.0 |
| 0.5 | 11.7 | 9.5 | 12.5 | 32.0 |
| 1.0 | 11.2 | 8.4 | 10.1 | 29.0 |
| 1.5 | 10.4 | 6.2 | 7.3 | 24.0 |

EXAMPLE 3

The procedure of Example 1 is used to prepare magnets, except that dysprosium oxide, or mixtures of aluminum and dysprosium oxide, are used as additives.

Properties of the magnets are summarized in Table III, which shows the considerable reduction in expensive rare earth oxide required to enhance coercivity when an aluminum additive is also used.

TABLE III

| Wt. Percent | | $B_r$ (Gauss | $H_c$ (Oersted | $iH_c$ (Oersted | $BH_{max}$ |
|---|---|---|---|---|---|
| Aluminum | $Dy_2O_3$ | $\times 10^3$) | $\times 10^3$) | $\times 10^3$) | (MGOe) |
| 0 | 0 | 12.3 | 9.0 | 11.6 | 35.0 |
| 0 | 2 | 11.4 | 10.7 | 13.5 | 31.5 |
| 0 | 4 | 11.2 | 10.8 | 16.0 | 31.0 |
| 0.5 | 2 | 11.0 | 10.5 | 15.9 | 27.0 |

Various embodiments and modifications of this invention have been described in the foregoing description and examples, and further modifications will be apparent to those skilled in the art. Such modifications are included within the scope of the invention as defined by the following claims.

What is claimed is:

1. A method for producing a rare earth-iron-boron permanent magnet, comprising the steps of:

(a) mixing a particulate alloy, containing at least one rare earth metal, iron, and boron, with particulate aluminum;

(b) aligning magnetic domains of the mixture in a magnetic field;

(c) compacting the aligned mixture to form a shape; and (d) sintering the compacted shape.

2. The method defined in claim 1, wherein the rare earth metal comprises a light rare earth.

3. The method defined in claim 2, wherein the rare earth metal comprises neodymium.

4. The method defined in claim 1, wherein the alloy further contains a ferromagnetic metal selected from the group consisiting of nickel, cobalt, and mixtures thereof.

5. The method defined in claim 1, wherein the alloy and aluminum are further mixed with at least one particulate rare earth oxide.

6. The method defined in claim 5, wherein the rare earth oxide comprises a heavy lanthanide oxide.

7. The method defined in claim 6, wherein the heavy lanthanide oxide is selected from the group consisting of gadolinium oxide, terbium oxide, dysprosium oxide, holmium oxide, and mixtures thereof.

8. The method defined in claim 7, wherein a heavy lanthanide oxide is selected from the group consisting of terbium oxide, dysprosium oxide, and mixtures thereof.

9. The method defined in claim 1, further comprising the step of:

(e) annealing the sintered shape.

10. The method defined in claim 1 wherein said rare earth-iron-boron permanent magnet comprises neodymium, iron, boron and about 0.05 to less than 1.0 percent by weight of aluminum.

11. A method for producing a neodymium-iron-boron permanent magnet, comprising the steps of:

(a) mixing a particulate alloy, containing neodymium, iron, and boron, with particulate aluminum;

(b) aligning magnetic domains of the mixture in a magnetic field;

(c) compacting the aligned mixture to form a shape; and (d) sintering the compacted shape.

12. The method defined in claim 11, wherein the alloy further contains a ferromagnetic metal selected from the group consisting of nickel, cobalt, and mixtures thereof.

13. The method defined in claim 11, wherein the alloy and aluminum are further mixed with at least one particulate heavy lanthanide oxide or heavy lanthanide metal.

14. The method defined in claim 13, wherein the heavy lanthanide oxide is selected from the group consisting of gadolinium oxide, terbium oxide, dysprosium oxide, holmium oxide, and mixtures thereof.

15. The method defined in claim 14, wherein the heavy lanthanide oxide is selected from the group consisting of terbium oxide, dysprosium oxide, and mixtures thereof.

16. The method defined in claim 11, further comprising the step of:

(e) annealing the sintered shape.

17. The method defined in claim 11 wherein said rare earth-iron-boron permanent magnet comprises neodymium, iron, boron and about 0.05 to less than 1.0 percent by weight of aluminum.

18. A method for producing a permanent magnet, comprising the steps of:

(a) mixing together the components:

(i) a particulate alloy consisting essentially of neodymium, iron, and boron;

(ii) particulate aluminum; and (iii) a particulate rare earth oxide selected from the group consisting of gadolinium oxide, terbium oxide, dysprosium oxide, holmium oxide, and mixtures thereof;

(b) aligning magnetic domains of the mixture in a magnetic field;

(c) compacting the aligned mixture to form a shape;

(d) sintering the compacted shape; and (e) annealing the sintered shape.

19. The method defined in claim 18, wherein the rare earth oxide is terbium oxide.

20. The method defined in claim 18, wherein the rare earth oxide is dysprosium oxide.

21. The method defined in claim 18 wherein said permanent magnet comprises neodymium, iron, boron and about 0.05 to less than 1.0 percent by weight of aluminum, and at least one rare oxide selected from the group consisting of gadolinium oxide, terbium oxide, dysprosium oxide and holmium oxide.

22. A method for producing a permanent magnet, comprising the steps of:

(a) mixing together the components:

(i) a particulate alloy consisting essentially of neodymium, iron, cobalt, and boron; and (ii) particulate aluminum;

(b) aligning magnetic domains of the mixture in a magnetic field;

(c) compacting the aligned mixture to form a shape;

(d) sintering the compacted shape; and (e) annealing the sintered shape.

23. The method defined in claim 22 wherein said permanent magnet comprises neodymium, iron, cobalt, boron and about 0.05 to less than 1.0 percent by weight of aluminum.

* * * * *